US009790455B2

(12) United States Patent
Motsenbocker

(10) Patent No.: US 9,790,455 B2
(45) **Date of Patent: *Oct. 17, 2017**

(54) LOW VOC COMPOSITION TO REMOVE FOOD, BEVERAGE, PET AND PROTEIN STAINS

(75) Inventor: Gregg Motsenbocker, San Diego, CA (US)

(73) Assignee: STONER, INC., Quarryville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/614,461

(22) Filed: Sep. 13, 2012

(65) Prior Publication Data

US 2016/0222326 A1 Aug. 4, 2016

(51) Int. Cl.

| | |
|---|---|
| ***C11D 3/26*** | (2006.01) |
| ***C11D 3/50*** | (2006.01) |
| ***C11D 7/26*** | (2006.01) |
| ***C11D 7/32*** | (2006.01) |
| ***C11D 7/50*** | (2006.01) |

(52) U.S. Cl.

CPC ..... *C11D 3/50* (2013.01); *C11D 7/263* (2013.01); *C11D 7/264* (2013.01); *C11D 7/265* (2013.01); *C11D 7/3245* (2013.01); *C11D 7/5013* (2013.01)

(58) Field of Classification Search

CPC ..... C11D 3/042; C11D 3/2068; C11D 3/2072; C11D 3/26; C11D 3/50

USPC ..... 510/101, 235, 342, 365, 437, 505, 506, 510/525

See application file for complete search history.

(56) References Cited

U.S. PATENT DOCUMENTS 5,227,085 A * 7/1993 Motsenbocker ..... C11D 3/3947 510/174

OTHER PUBLICATIONS

Office Action issued in related U.S. Appl. No. 13/614,723, dated Jul. 12, 2016.

* cited by examiner

*Primary Examiner* — Brian P Mruk

(74) *Attorney, Agent, or Firm* — Foley & Lardner LLP

(57) ABSTRACT

A Low-VOC, water-based cleaner containing Baypure CX 100/34 or EDTA Versene 100, Glycol Ether DPNP, or glycol ether EB and DB, Acetone, Acetic Acid, and fragrance. The VOC content of this composition is selectable to be 3.0% or 0% (zero).

6 Claims, No Drawings

LOW VOC COMPOSITION TO REMOVE FOOD, BEVERAGE, PET AND PROTEIN STAINS

FIELD OF THE INVENTION

Compositions to remove food, beverage, pet, and miscellaneous protein stains from surfaces such as tools, hands, fiberglass, and other surfaces so as to restore them as closely as possible to a clean condition.

BACKGROUND OF THE INVENTION

Surfaces, such as tools, hands, carpet, clothing, to name only a few, and hard surfaces such as tile, wallpaper and wood floors, often receive deleterious deposits and stains. Such deposits vary widely in their identity. Some may be quite viscous, for example mustard, catsup, and mayonnaise. Other are more liquid in nature, such as pet stains, wines, and soft drinks. Still others may be more solid or pasty, including foods, especially proteinaceous foods.

The above recitation exemplifies a broad range of materials which need to be cleaned from a broad range of deposits and stains. In response to this need, an equally wide range of cleaning compositions already exists in the market.

Generally speaking, commercial compositions are limited both in the range of their effectiveness, and also as to how efficient they really are for their intended purpose. If one intends to remove a wide range of kinds of deposits, he is likely to find a nearly-equal number of formulations to buy for the purpose. In addition, some of the stains and deposits are usually only partially removed, and with risk to the material being cleaned. On the consumer market today, for example, there is no known composition which will remove marking red wine from a white tablecloth. This product will.

Furthermore, many existing compositions are objectionable from an environmental standpoint. This composition is water-based, and is environmentally acceptable. The composition is available in 0% and 3% Volatile Organic Compound (VOC) configurations and will perform surface cleaning. This is important because, for example, the California Air Resources Board (CARB) and Cal-EPA regularly publish new limits on VOC content for household products.

It is an object of this invention to provide a water-based environmentally acceptable, biodegradable cleaning composition which can be used to remove a surprisingly large range of types of deposits and stains from any substrate. Any residue of these compositions which might remain on the surface, or in the fabric underlying it, will not adversely affect the user or the surface to which it was applied. It has proved to be a considerable surprise to observe how many types of really difficult stains and deposits these compositions can remove, with little or no remaining evidence that there ever had been a stain or a deposit, or that the composition ever had been applied, all without damage to the material being cleaned.

It is another object to provide a small family of related compositions, which between them can attend to all but a few of the types of deposits and stains which predictably will be experienced.

BRIEF DESCRIPTION OF THE INVENTION

A composition according to this invention which provides a wide range of applications is water-based and comprises, in addition to water, EDTA Versene 100, Glycol Ether DPNP, acetone, and acetic acid. Alternate versions of the formula substitute Baypure CX 100/34% for EDTA Versene 100 and substitute Glycol Ether EB and/or DB for Glycol Ether DPNP.

The various versions of the formula are Low-VOC, with a maximum VOC content of 3.0%. This composition is surprisingly effective for the removal of beverage stains, pet stains, food stains and deposits, latex-based paints, proteins, dust, and corrosion preservatives.

This formulation represents a paradigm shift away from traditional cleaners. All cleaners in the market today clean specified substrates, e.g. tile cleaner, bathroom cleaner, floor cleaner, carpet cleaner, pre-wash; this formulation attacks specific stain types, for ANY substrate. Cleaners in today's market are basically just soap and water. This VOC-compliant formulation works better than non-VOC-formulations in the market, remaining safe for the environment, safe for the individual, and safe for any surface.

DETAILED DESCRIPTION OF THE INVENTION

The basic formulation of this invention, itself useful for cleaning a wide range of substrate materials from deposits and stains is an aqueous solution of EDTA Versene 100, Glycol ether DPNP, acetone, acetic acid, and fragrance. This solution is biodegradable with 0% VOC content, and is applicable to a wide range of materials without damaging them. It is best to wash it out after the solution has done its work—it does leave a small but usually unobjectionable deposit. The components of the solution are benign, and if left in place will cause no damage to the substrate (soiled) material to which the solution is applied, nor to persons who come in contact with it.

The combination of components used herein appears to function synergistically, by mechanisms which are not fully understood at this time. What has become apparent is that the total composition functions to a degree of effectiveness much greater than already-known compositions useful for the intended purposes, and that elimination of any of the components greatly reduces the effectiveness of the composition.

As a preliminary observation, it should be noted that purified water (either distilled, de-ionized or softened), is preferred. If it is used, the solution will be clear. If water is used which is not purified, then the solution is likely to be cloudy and sometimes less acceptable to the user. However, some users might actually prefer a cloudy or milky composition. Use of tap water will usually result in this. The result of this is that, no matter where the composition is mixed, using local water supplies, the resulting composition is the same.

The above basic formulation, for which more detailed specifications will be given below removes beverages and their stains and removes protein based foods, sauces and condiments. It can be used on all substrates such as clothing, carpets, athletic shoes, wall, floors, wall papers, and many others.

Some stains and deposits are more resistant to the basic formulation, usually because their dyes or other colorizers must be attended to either by decolorizing them, or by solubilizing them. Examples of these materials are various inks. These are notoriously difficult to remove using other products without damage to cloth, with the use of cleaning solutions generally available in a household, and with the skill and knowledge of the householder. Especially this is the situation where water-based formulations are needed. This invention provides excellent results without recourse to aromatic or petroleum solvents.

The modified formulation to be described can be directly applied to many troublesome stains and left there. The stain quickly disappears. Washing out the garment or blotting it is optional, but it is best practice to wash it out, or at least to blot it out. There will be no damage to any but the most fragile fabrics and none to many of such fabrics. The modified formulation is also useful for wood stripping, when some color removal is desired.

The presently preferred basic formulation is the 3% formulation as follows:

| CAS Numbers | |
|---|---|
| EDTA Versene 100 | 60-00-4 |
| Baypure CX 100/34% | 144538--83-8 |
| Glycol ether EB and DPNP | 111-76-2 |
| Glycol ether DB | 112-34-5 |
| Acetone | 67-64-1 |
| Acetic acid | 64-19-17 |
| De-ionized water | 7732-18-5 |

In all the the formulations and guidelines given below, at least one substance from each group must be included.

The preferred embodiment is directly below, the 0% VOC Formulation.

| 0% VOC Formulation percentages | | |
|---|---|---|
| a. | De-ionized water | 73.01 |
| b. | EDTA Versene 100 | 9.65 |
| c. | Glycol ether DPNP | 7.85 |
| e. | Acetone | 8.65 |
| f. | Acetic acid | 0.44 |
| g. | Fragrance | 0.40 |

| Variable 0% VOC formulation percentages | | |
|---|---|---|
| a. | De-ionized water | 71.86-79.86 |
| b. | EDTA Versene 100 | 9.65 |
| c. | Glycol ether DPNP | 1.0-9.0 |
| e. | Acetone | 8.65 |
| f. | Acetic acid | 0.44 |
| g. | Fragrance | 0.40 |

| 3% VOC Formulation percentages | | |
|---|---|---|
| a. | De-ionized water | 73.86 |
| b. | Baypure CX 100/34 | 9.65 |
| c. | Glycol ether EB | 3.00 |
| | Glycol ether DB | 4.00 |
| e. | Acetone | 8.65 |
| f. | Acetic acid | 0.44 |
| g. | Fragrance | 0.40 |

| Variable VOC Formulation A | | |
|---|---|---|
| a. | De-ionized water | (varies) |
| b. | Baypure CX 100/34 | 9.65 |
| c. | Glycol ether DPNP | 1.0-9.0 |
| | Glycol ether DB | 1.0-9.0 |
| e. | Acetone | 8.65 |
| f. | Acetic acid | 0.44 |
| g. | Fragrance | 0.40 |

(Note:
the amount of part a., de-ionized water, will vary depending on the DPNP and DB percentages selected for part c.)

| Variable VOC Formulation B | | |
|---|---|---|
| a. | De-ionized water | (varies) |
| b. | Baypure CX 100/34 | 9.65 |
| c. | Glycol ether EB | 1.0-3.0 |
| | Glycol ether DB | 1.0-9.0 |
| e. | Acetone | 8.65 |
| f. | Acetic acid | 0.44 |
| g. | Fragrance | 0.40 |

(Note:
the amount of part a., de-ionized water, will vary depending on the EB and DB percentages selected for part c.)

This invention is not to be limited to the embodiments described in the description which are given by way of example and not of limitation, but only in accordance with the scope of the appended claims.

I claim:

1. A water-based composition for removing stains from substrates, wherein the composition has a Volatile Organic Compound (VOC) level of zero percent, and the composition consists essentially of:

| | |
|---|---|
| (a) de-ionized water | 73.01%; |
| (b) about 39 wt % $Na_4EDTA$ in water | 9.65%; |
| (c) Dipropylene glycol n-propyl ether | 7.85%; |
| (d) acetone | 8.65%; |
| (e) acetic acid | 0.44%; and |
| (f) fragrance | 0.40%. |

2. A water-based composition for removing stains from substrates, wherein the composition has a Volatile Organic Compound (VOC) level of zero percent, and the composition consists essentially of:

| | |
|---|---|
| (a) de-ionized water | 71.86-79.86%; |
| (b) about 39 wt % $Na_4EDTA$ in water | 9.65%; |
| (c) Dipropylene glycol n-propyl ether | 1.0-9.0%; |
| (d) acetone | 8.65%; |
| (e) acetic acid | 0.44%; and |
| (f) fragrance | 0.40%. |

3. A water-based composition for removing stains from substrates, wherein the composition has a Volatile Organic Compound (VOC) level of 3%, and the composition consists essentially of:

| | |
|---|---|
| (a) de-ionized water | 73.86%; |
| (b) 34% solution of tetrasodium iminodisuccinate in water | 9.65%; |
| (c) Ethylene glycol n-butyl ether | 3.00%; |
| (d) Diethylene glycol monobutyl ether | 4.00%; |
| (e) acetone | 8.65%; |
| (f) acetic acid | 0.44%; and |
| (g) fragrance | 0.40%. |

4. A water-based composition for removing stains from substrates, wherein the composition has a Volatile Organic Compound (VOC) level of 3% or less, and the composition consists essentially of:

| | |
|---|---|
| (a) de-ionized water, the amount selected to complete the composition to | 100%; |
| (b) 34% solution of tetrasodium iminodisuccinate in water | 9.65%; |
| (c) Dipropylene glycol n-propyl ether | 1.0-9.0%; |

-continued

| | |
|---|---|
| (d) Diethylene glycol monobutyl ether | 1.0-9.0%; |
| (e) acetone | 8.65%; |
| (f) acetic acid | 0.44%; and |
| (g) fragrance | 0.40%. |

5. A water-based composition for removing stains from substrates, wherein the composition has a Volatile Organic Compound (VOC) level of 3% or less, and the composition consists essentially of:

| | |
|---|---|
| (a) de-ionized water, the amount selected to complete the composition to | 100%; |
| (b) 34% solution of tetrasodium iminodisuccinate in water | 9.65%; |
| (c) Ethylene glycol n-butyl ether | 1.0-3.0%; |
| (d) Diethylene glycol monobutyl ether | 1.0-9.0%; |

-continued

| | |
|---|---|
| (e) acetone | 8.65%; |
| (f) acetic acid | 0.44%; and |
| (g) fragrance | 0.40%. |

6. A water-based composition for removing stains from substrates, wherein the composition has a Volatile Organic Compound (VOC) level of between 1.0 and 3.0%, and the composition consists essentially of:

(a) water;

(b) about 39 wt % $Na_4EDTA$ in water or 34% solution of tetrasodium iminodisuccinate in water;

(c) Dipropylene glycol n-propyl ether, Ethylene glycol n-butyl ether, Diethylene glycol monobutyl ether, or any combination thereof;

(d) acetone; and (e) acetic acid.

* * * * *